US012291383B2

(12) United States Patent
Gmeindner et al.

(10) Patent No.: US 12,291,383 B2
(45) Date of Patent: May 6, 2025

(54) PUSH-THROUGH COVER FOIL WITH A PLURALITY OF NON-INTERSECTING MATERIAL WEAKENINGS AND PUSH-THROUGH PACK WITH SUCH A COVER FOIL

(71) Applicant: Huhtamaki Flexible Packaging Germany GmbH & Co. KG, Ronsberg (DE)

(72) Inventors: Andreas Gmeindner, Obergünzburg (DE); Tobias Fackler, Illerbeuren (DE); Fabio Daidone, Ronsberg (DE)

(73) Assignee: Huhtamaki Flexible Packaging Germany GmbH & Co. KG, Ronsberg (DE)

( * ) Notice: Subject to any disclaimer, the term of this patent is extended or adjusted under 35 U.S.C. 154(b) by 100 days.

(21) Appl. No.: 18/127,919

(22) Filed: Mar. 29, 2023

(65) Prior Publication Data

US 2023/0312208 A1 Oct. 5, 2023

(30) Foreign Application Priority Data

Mar. 31, 2022 (DE) ..... 10 2022 107 651.2

(51) Int. Cl.
*B65D 75/32* (2006.01)

(52) U.S. Cl.
CPC .... *B65D 75/327* (2013.01); *B65D 2575/3227* (2013.01); *B65D 2575/367* (2013.01)

(58) Field of Classification Search
CPC ..... B65D 2575/367; B65D 75/327; B65D 2575/3227

(Continued)

(56) References Cited

U.S. PATENT DOCUMENTS 5,469,968 A * 11/1995 Matthews ..... B65D 75/327 206/532

8,079,475 B2 12/2011 McArthur et al.

(Continued)

FOREIGN PATENT DOCUMENTS

JP 2003300538 A 10/2003

OTHER PUBLICATIONS

German Search Report for corresponding DE 10 2022 107 651.2 mailed Nov. 23, 2022, 7 pgs.

(Continued)

*Primary Examiner* — Chun Hoi Cheung
(74) *Attorney, Agent, or Firm* — Rankin, Hill & Clark LLP

(57) ABSTRACT

A push-through cover foil, including at least one material layer with material weakenings introduced into it in a regular pattern, through which locally a material cohesion of at least one material of the cover foil is broken, where the material weakenings proceed in the thickness direction of the cover foil without completely penetrating through the cover foil, where the material weakenings exhibit a linear course orthogonally to the thickness direction, where the cover foil exhibits a plurality of parallel rows of material weakenings, where each row exhibits a plurality of material weakenings parallel to one another and arranged with a weakening spacing from one another, where the parallel rows of material weakenings are arranged with a row spacing from one another such that neither the material weakenings of the individual rows among themselves nor the material weakenings of adjacent rows intersect one another.

13 Claims, 5 Drawing Sheets

(58) Field of Classification Search
USPC ..... 206/531, 534.1
See application file for complete search history.

(56) References Cited

U.S. PATENT DOCUMENTS

| | | | | |
|---|---|---|---|---|
| 9,138,378 | B2 | 9/2015 | McArthur et al. | |
| 9,439,832 | B2 * | 9/2016 | Trombley | A61J 1/035 |
| 9,717,650 | B2 | 8/2017 | Johnston et al. | |
| 10,450,126 | B2 | 10/2019 | Branyon et al. | |
| 2008/0230432 | A1 | 9/2008 | Bobbett et al. | |
| 2009/0145800 | A1 * | 6/2009 | Bowers | B65D 75/327 206/532 |
| 2009/0188827 | A1 * | 7/2009 | McArthur | B65D 75/327 206/461 |
| 2010/0072104 | A1 * | 3/2010 | Kohl | B65B 61/02 53/471 |
| 2016/0257438 | A1 * | 9/2016 | Van Landeghem | B32B 27/36 |
| 2022/0144515 | A1 * | 5/2022 | Priscal | B32B 27/08 |

OTHER PUBLICATIONS

Espacenet Bibliographic data: JP 2003300538 (A), Published Oct. 21, 2003, 1 pg.
Extended European Search Report for corresponding 23165775.0-1014 mailed Sep. 7, 2023, 7 pgs.

* cited by examiner

PUSH-THROUGH COVER FOIL WITH A PLURALITY OF NON-INTERSECTING MATERIAL WEAKENINGS AND PUSH-THROUGH PACK WITH SUCH A COVER FOIL

This Application claims priority in German Patent Application DE 10 2022 107 651.2 filed on Mar. 31, 2022, which is incorporated by reference herein.

The present invention concerns a push-through cover foil, comprising at least one material layer with material weakenings introduced into it in a regular pattern, through which locally a material cohesion of at least one material of the cover foil is broken, where the material weakenings proceed in the thickness direction of the cover foil without completely penetrating through the cover foil, where the material weakenings exhibit a linear course orthogonally to the thickness direction.

BACKGROUND OF THE INVENTION

Such a push-through cover foil is known from U.S. Pat. No. 9,138,378 B2 or also from U.S. Pat. No. 10,450,126 B2. Like the present push-through cover foil, the push-through cover foils known from the aforementioned publications are also suitable and normally intended for covering accommodation volumes of push-through packs or more specifically blister packs. In such push-through or blister packs as the case may be, there are normally accommodated tablets or suppositories, i.e. pharmaceutical products for administration in body cavities. It should, however, not be ruled out that an arbitrary other product is packaged in a push-through pack according to the invention, such as for example an electronic component or the like.

The push-through cover foils known from the aforementioned US publications utilize intersecting linear material weakenings, with a predetermined minimum number of intersection points per area section covers which an accommodation volume of a blister pack, in order to ensure the opening of a respective accommodation volume and the removal of the product packaged in it. The known cover foil, like those of the present application, can be pushed through, since by means of the packaged product a local mechanical stress can be exerted on the cover foil through deformation of the blister pack, which in the region of one or several material weakenings exceeds the tear strength of the locally weakened cover foil thus allowing tearing open of the cover foil over an accommodation volume of a blister pack and ultimately the removal of the packaged product from the accommodation volume.

The drawback in these known cover foils is the occasionally excessive weakening at the intersection points of the linear material weakenings of the cover foil resulting from the material weakenings. It is precisely at the intersection points of the linear material weakenings that the intersecting material weakenings can propagate further even under a small mechanical load and thereby locally weaken the cover foil increasingly more strongly than originally intended. Consequently, undesirable water vapor and/or oxygen can migrate more easily and thus more rapidly and/or in larger quantities from the external environment through the cover foil into the accommodation volume than is desirable for the stability of the packaged product.

There are furthermore known push-through cover foils which exhibit an aluminum foil. Due to the material properties of aluminum, the aluminum foil can on the one hand be easily pressed through, i.e. be caused to tear with the packaged product as a force transmitter. On the other, the aluminum foil provides an outstanding barrier to the migration of oxygen and first and foremost of water vapor from the environment through the cover foil into the accommodation volume. The push-through cover foil with the aluminum foil can be configured as very thin, since fundamentally the aluminum foil has to carry merely an adhesive layer or a hot-sealable polymer layer in order to combine it with a container component of the push-through pack into a push-through pack.

However, the use of aluminum foils as barrier material in the cover foils leads to difficult or impossible recycling of a push-through or blister pack, as the case may be, which uses such a cover foil to seal one or several accommodating recesses in a container component of the blister pack. The cover foil is combined firmly with the container component, which leads to the described recycling problems.

SUMMARY OF THE INVENTION

It is, therefore, the task of the present invention to provide a push-through cover foil which facilitates the recycling of a blister pack using the cover foil and which nevertheless exhibits good barrier properties, in particular a good water vapor barrier to the migration of water vapor.

The present invention solves this task in a push-through cover foil of the type mentioned at the beginning by the cover foil exhibiting a plurality of parallel rows of material weakenings, where each row exhibits a plurality of material weakenings parallel to one another and arranged with a weakening spacing from one another, where the parallel rows of material weakenings are arranged with a row spacing from one another such that neither the material weakenings of the individual rows among themselves nor the material weakenings of adjacent rows intersect one another.

Through this arrangement of material weakenings, on the one hand the cover foil can be sufficiently mechanically weakened such that blister packs configured with it can also be opened by older persons without problems by pushing the cover foil through. At the same time, local excessive weakening, referred to as 'barrier hotspot', is avoided by avoiding intersection points between individual material weakenings.

The use of parallel linear material weakenings ensures that when pushing the cover foil through, tear propagation is guided along the material weakening and between a material weakening of one row and a material weakening of a further row parallel to the row has to surmount only a comparatively small distance in order to then encounter in the further row a further material weakening, which for preference is essentially identically oriented and which continues the initiated tear, preferably with essentially the same tear propagation direction. Consequently, a tear once initiated at a material weakening can be extended with a comparatively low force application all the way across several rows of material weakenings to an altogether long tear, which ultimately allows removal of the product from the accommodation volume initially sealed by the cover foil.

By "linear" it is stated that the material weakening is configured essentially one-dimensionally orthogonally to its depth direction which proceeds in the thickness direction of the cover foil, i.e. has a significantly greater length than width. The width direction of the material weakening likewise proceeds orthogonally to the depth direction and orthogonally to the running direction of the material weakening. The width is the shorter dimension compared with the running length which likewise is orthogonal to the depth.

The width of the material weakening is preferably determined by the width of the tool producing it, i.e. for instance through a mechanical blade and/or through a laser beam. The material weakening is preferably at least 10 times longer than wide.

Material weakenings can in principle proceed in curved linear courses, for instance as an arched, zigzag, or wavy line. Preferably in terms of production engineering and for reasons of the achievable higher mean strength of the cover foil, the material weakenings proceed along a straight line orthogonally to their depth direction.

In the present application, the terms 'push-through pack' and 'blister pack' are used synonymously.

In the following, the push-through cover foil will often also be referred to only as a cover foil. However, without express references to a different interpretation this always means the push-through cover foil.

In order to be able to provide even in relatively large aperture areas which are to be sealed by the cover foil in a push-through pack the most uniform pattern possible and thereby the most uniform opening behavior possible across the whole blister pack, which normally exhibits a plurality of accommodation volumes arranged pattern-like, the cover foil can be further refined in such a way that out of a plurality of parallel rows with material weakenings within each row which are respectively parallel to one another, each row exhibits along its row extension direction which is orthogonal to the row spacing a row width determined by the material weakenings of the respective row, where the row width is constant and orthogonal to the row extension direction.

Therefore material weakenings which are parallel to one another are preferably configured essentially identically, in particular with an identical course length along their linear course.

Additionally or alternatively, it is conceivable for the constant row width to be larger than the constant row spacing between adjacent rows of constant width. Thereby, when opening an accommodation volume of a blister pack, a tear once initiated at a first material weakening can more easily be propagated over a greater tear length, since between two adjacent rows with material weakenings parallel to one another within each row it has to travel a shorter distance between the adjacent rows without guidance by a material weakening than it can travel within a row guided by a material weakening.

Material weakenings of a row parallel to one another have the shortest possible course length when their parallel running directions proceed orthogonally to the row extension direction. In order to be able to provide within a row with a plurality of material weakenings parallel to one another an advantageously long or longer as the case may be region for initiating a tear or of for continuing and/or guiding respectively a tear already initiated, it is advantageous if running directions of the material weakenings parallel to one another of a row and orthogonal to the thickness direction of the cover foil enclose with the row extension direction a setting angle different from 90°.

A tear starting from the end of a material weakening of a row and propagating over a region of the cover foil free from material weakenings and therefore unguided by material weakenings has to surmount, in most opening attempts, an advantageously short distance which is unguided by material weakenings between two rows with parallel material weakenings, when the parallel material weakenings of one row are arranged offset, along the common row extension direction of the two rows, relative to the further material weakenings of a further parallel row which are directionally aligned with the material weakenings of this row.

In principle, rows are defined by exhibiting material weakenings which are parallel to one another, i.e. by material weakenings within one row being parallel to one another. This does not necessarily mean that material weakenings of other rows, which in turn are parallel to one another in order to define their respective row, are also parallel to material weakenings of another row. This, however, is preferable. And this is what is meant in the previous paragraph by directionally aligned further material weakenings of a further row. In this case, the row and the further row exhibit not only material weakenings which are parallel with one another within their respective row, but also across the rows.

In order to simplify the fabrication of the cover foil, it is advantageous if the cover foil exhibits a plurality of parallel equal rows, in which material weakenings with a uniform setting angle and with a uniform weakening spacing are configured. Thus in these equal rows, material weakenings are parallel to one another not only within the respective row, but also across the rows.

According to a preferred embodiment, it can be provided that the cover foil exhibits not only a single type of equal rows, but more than one type of equal rows. Thereby the area regions in which a tear initiation and/or tear propagation is ensured in and into the cover foil can be advantageously enlarged.

Consequently, the plurality of equal rows can for example be a plurality of first rows in which material weakenings parallel to one another are configured with a uniform first setting angle and with a uniform first weakening spacing.

The cover foil can further exhibit a plurality of parallel second equal rows in which material weakenings parallel to one another are configured with a uniform second setting angle different from the first one and with a uniform second weakening spacing.

Then preferably between two first rows there is arranged at least one second row and preferably between two second rows there is arranged at least one first row. Here the first weakening spacing and the second weakening spacing can be equal in size or differ in size.

The first rows here are preferably not only parallel to one another respectively, but also to second rows and of course vice versa.

In principle it should suffice if a row of material weakenings parallel to one another exhibits those very material weakenings parallel to one another, where it should not be ruled out that further material weakenings are located in the row which are not parallel to the material weakenings parallel to one another which define the row. Preferably, however, a row of material weakenings parallel to one another exhibits only the material weakenings parallel to one another. This preferably applies both to first and to second rows.

In cover foils configured especially advantageously, with a very high probability of tear initiation and/or tear propagation regardless of the location of the tear initiation and/or tear propagation, it is possible to define rows parallel to one another with material weakenings parallel to one another within each row, where in the parallel rows there is also configured at least one material weakening which is not parallel to the material weakenings which are parallel to one another, and it is possible to define other rows parallel to one another with only material weakenings parallel to one another in each. Normally, the former parallel rows and the other parallel rows are rotated with respect to each other by a rotation angle about a rotation axis which is orthogonal to the surface of the cover foil.

The advantageous arrangement described above of material weakenings in the cover foil permits the advantageous configuration of a push-through cover foil which is free from an aluminum foil layer is and which therefore together with the rest of the blister pack in which it is inserted can be easily recycled.

The push-through cover foil can comprise or be a mono-material polymer foil. The mono-material polymer foil consists only of polymer material based in the same monomer.

In the simplest case, the push-through cover foil can be a polymer mono-foil, i.e. a single-layer foil made from a uniform polymer material, such as for example polyethylene terephthalate (PET) or from a polyolefin, for instance polyethylene or polypropylene, in particular from a monoaxially oriented or biaxially oriented polypropylene. Likewise conceivable is a blend from a polyolefin, in particular polypropylene, and a cyclo-olefin copolymer (COC).

When the push-through cover foil comprises or consists of several layers of polymer material, the polymers of the several layers are preferably based on the same monomer, in order to improve the recyclability of the cover foil.

The push-through cover foil preferably comprises an exposed sealing layer, in order to be able to bond it firmly through hot sealing with a container component of a push-through pack. To this end, the polyethylene terephthalate foil or the polypropylene foil can preferably be configured as a sealable polyethylene terephthalate foil or sealable polypropylene foil respectively, although it should not be ruled out that the push-through cover foil carries a separately applied sealing layer. Such a sealing layer can for example be a sealing layer on a polyethylene or polypropylene base or sealing varnish.

Depending on how the push-through cover foil should be arranged at a container component of a push-through pack, the material weakenings of the cover foil can extend from the seal side, i.e. starting from the side of the sealable outer surface, in the thickness direction into the cover foil or from the side opposite to the seal side.

Preferably the push-through cover foil exhibits a thickness of no less than 20 μm, preferably of no less than 30 μm. Likewise preferably, the cover foil exhibits a thickness of no more than 100 μm, especially preferably of no more than 50 μm. Regardless of the thickness of the cover foil, it should exhibit a residual wall thickness of 5 μm in the material cohesion which is undisturbed material weakenings. Expressed as a percentage, out of the total thickness of the cover foil preferably at least 25%, better still 33%, should remain unslotted, i.e. not impaired in its material cohesion by the formation of material weakenings. However, the material weakenings should extend over at least one fourth, better still a third, of the thickness of the cover foil in order to be able to provide secure manual tear initiation and tear guiding.

Although the aforementioned mono-material polymer foil is preferred for reasons of facilitated recycling, it should not be ruled out that the push-through cover foil barrier exhibits layers. These can be ceramic barrier layers, comprising for instance aluminum oxide and/or silicon oxide, and/or this can be vacuum-deposited metallization which is considerably thinner than the aluminum foil criticized above and therefore impairs the recycling of the cover foil and of the blister pack using it less strongly than the inclusion of a barrier layer made from aluminum foil.

Preferably the push-through cover foil exhibits a water vapor barrier pursuant to DIN EN ISO 15106-3, measured at 38° C. and 90% relative air humidity, at less than 1 g per $m^2$ per day, preferably at less than 0.5 g per $m^2$ per day.

Preferably the push-through cover foil exhibits an oxygen barrier pursuant to DIN 53380-3, measured at 23° C. and 85% relative air humidity, at less than 1 $cm^3$ per $m^2$ per day per bar, preferably at less than 0.5 $cm^3$ per $m^2$ per day per bar. 1 bar corresponds to 100 kPa in SI units.

The present invention further concerns a push-through pack, comprising a manually deformable container component with at least one accommodation volume framed by the container component for accommodating a product to be packaged, where the accommodation volume is reducible by manually exerting a force. For removing the product to be packaged, the container component exhibits a removal aperture which is sealed by a push-through cover foil as described and further refined above. The material weakenings of the push-through cover foil are preferably dimensioned relative to the dimensions of the removal aperture covered by it in such a way that within the aperture area framed by the removal aperture and covered by the push-through cover foil more than one row of material weakenings parallel to one another are present and at least two of these rows each exhibit more than one material weakening.

For reasons of improved recycling of such a push-through pack, the container component is preferably formed from a polymer material which in terms of weight is also to at least two thirds, i.e. to at least 66.6 percent by weight, is the polymer material of the push-through cover foil. At least 90, better still 95, percent by weight of the polymer material of the container component on the one hand and at least 66.6 percent by weight, preferably at least 90, better still 95, percent by weight of the polymer material of the cover foil on the other hand are based on the same monomer.

According to a first embodiment of the push-through pack, the material weakenings in the push-through cover foil, starting on the outer side which faces away from the at least one accommodation volume, can proceed in the thickness direction in the direction towards the inner side which faces towards the at least one accommodation volume and lies opposite to the outer side.

According to an alternative second embodiment of the push-through pack, the material weakenings in the push-through cover foil, starting on the inner side which faces towards the at least one accommodation volume, can proceed in the thickness direction in the direction towards the outer side which faces away from the at least one accommodation volume and lies opposite to the inner side.

These and other objects, aspects, features and advantages of the invention will become apparent to those skilled in the art upon a reading of the Detailed Description of the invention set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which forms a part hereof and wherein.

DESCRIPTION OF PREFERRED EMBODIMENTS

Figure 1:
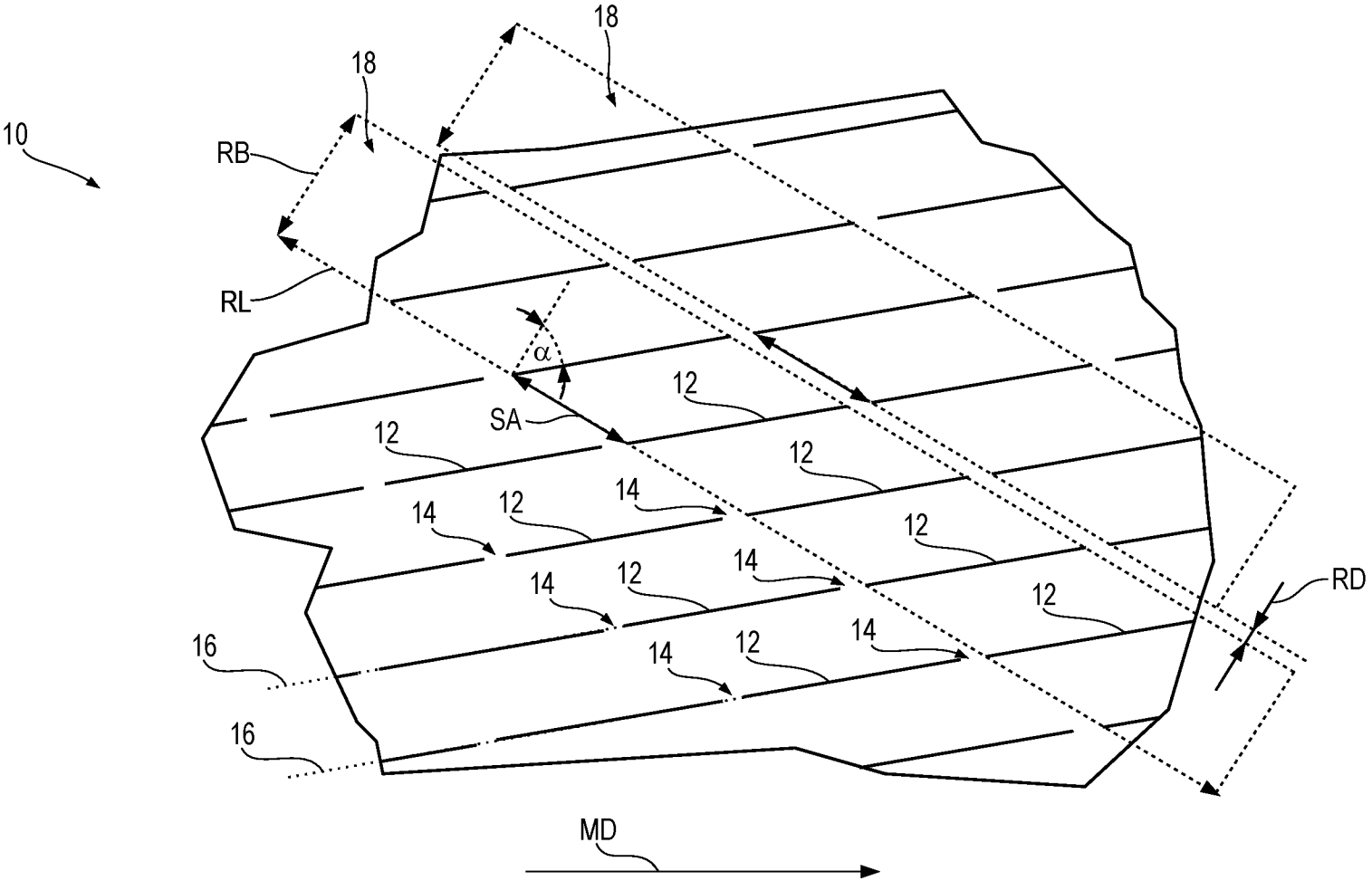
FIG. 1 A first embodiment of a push-through cover foil according to the invention in a top view with a first pattern of linear material weakenings discerned thereon, FIG. 2 A second embodiment of a push-through cover foil according to the invention in a top view with a second pattern of linear material weakenings discerned thereon, FIG. 3 A third embodiment of a push-through cover foil according to the invention in a top view with a third pattern of linear material weakenings discerned thereon, FIG. 4 A first embodiment of a push-through pack according to the invention, and FIG. 5 A second embodiment of a push-through pack according to the invention.

Referring now to the drawings wherein the showings are for the purpose of illustrating preferred and alternative embodiments of the invention only and not for the purpose of limiting the same, in FIG. 1, an embodiment first according to the invention of a push-through cover foil is labelled generally by 10. FIG. 1 shows the cover foil 10 in a top view with a plurality of linear material weakenings 12 each of the same length and same orientation. The material weakenings 12 are arranged behind each other in parallel lines 16 with breaks 14. The breaks 14 of different lines 16 are arranged offset relative to one another, such that when proceeding from a break 14 from a starting line 16 orthogonally to an adjacent line 16, one does not encounter a break 14 in the adjacent line 16 but a material weakening 12.

Since the offsetting of breaks 14 between two parallel lines 16 is preferably of the same magnitude across all pairwise adjacent lines, this yields parallel rows 18 each of which contains material weakenings 12 parallel to one another. Since the first embodiment of the push-through cover foil 10 exhibits only a single type of material weakening 12, all of which are directionally aligned and exhibit the same length, for one thing each row 18 comprises only material weakenings 12 parallel to one another, and for another the material weakenings 12 of one row 18 are likewise parallel to the material weakenings 12 of an adjacent row 18.

The rows 18 extend along a row length direction RL and exhibit a row width RB which is orthogonal to the row length direction RL. The material weakenings 12 which are parallel to one another of a row 18 are tilted by an angle $\alpha$ with respect to a line parallel to the row width RB. The angle $\alpha$ can be negative, as in the case of the embodiment of FIG. 1. In fact only its magnitude is important.

The row width RB equals in the present case the running length (see running length VL in FIGS. 2 and 3) multiplied by the cosine of the angle $\alpha$. Accordingly, the row spacing RD between two immediately adjacent rows 18 which is orthogonal to the row length direction RL equals the running length of the break 14 along a line 16 multiplied by the cosine of the angle $\alpha$.

The material weakenings 12 parallel to one another of a row 18 are separated from one another within the row 18 by a weakening spacing SA to be measured along the row length direction RL. Although not absolutely necessary, nevertheless it is preferable for the weakening spacing SA to be constant along the row length direction RL.

The machine direction MD, along which a material web of the cover foil runs through the machine fabricating it, can be oriented arbitrarily relative to the rows 18 or relative to the lines 16, as the case may be. An example is shown in FIG. 1. The lines 16 are tilted in the depicted embodiment example by 10° with respect to the machine direction MD. This value is given merely as an example.

In FIG. 1 the running length of the straight material weakenings 12 is preferably between 3 and 6 mm, especially preferably between 4.5 and 5.5 mm, and most preferably about 5 mm.

The breaks 14 configured between two immediately adjacent material weakenings 12 in the direction of a line 16, in which the material cohesion of the cover foil 10 is not weakened, exhibit a length in the direction of the line 16 of preferably 5% to 15%, especially preferably of 8% to 12%, most preferably of 10%, of the running length of the material weakenings 12. In absolute terms, the break 14 can have a length of between 0.3 and 0.9 mm in the direction of the line 16, preferably of 0.4 to 0.6 mm, and especially preferably of 0.5 mm.

The weakening spacing SA can be chosen arbitrarily, in the present case it can for example lie between 40% and 60% of the running length of the straight material weakenings 12. Expressed in absolute terms, the weakening spacing SA can preferably lie between 1.2 and 3.6 mm, especially preferably between 1.8 and 3.3 mm, and especially preferably between 2.4 and 3 mm.

The material weakenings 12 of the first embodiment can be introduced thermally and/or mechanically as the case may be by means of laser beams or by means of a bladed drum, starting from an exposed surface of the cover foil 10, in its depth direction which is orthogonal to the drawing plane of FIG. 1.

Figure 2:
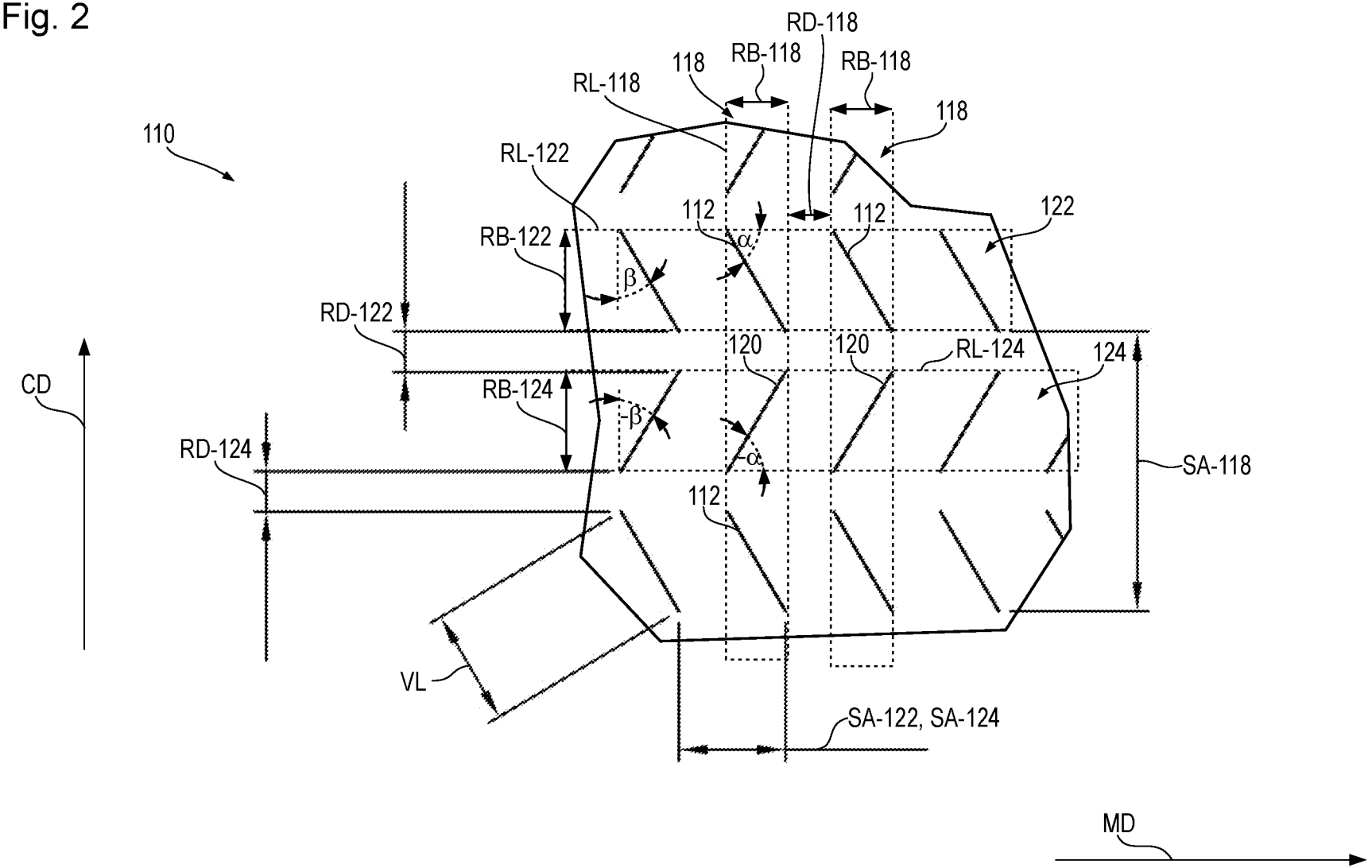

In FIG. 2 there is shown a second embodiment of a push-through cover foil. Identical and functionally identical components and component sections as in the first embodiment are labelled in the second embodiment by the same reference symbols but increased numerically by 100. The second embodiment is described below only in so far as it differs from the first embodiment, to the description of which reference is otherwise made for elucidating the second embodiment also.

In contrast to the first embodiment, in the push-through cover foil 110 of FIG. 2 there is introduced not only a single type of material weakenings 112 into the cover foil 110 but beyond that a second type of material weakenings 120. The material weakenings 112 are therefore referred to below as first material weakenings 112 and the material weakenings 120 are referred to below as second material weakenings 120.

The depth direction of the cover foil 110 proceeds as in the first embodiment 10 of FIG. 1 orthogonally to the drawing plane of its depiction, i.e. here of FIG. 2. The machine direction MD is once again shown in FIG. 2 by way of example, but it can proceed in an arbitrary other direction and can in particular be rotated by 45° or by 30°, by 60°, or by other angles with respect to a rotation axis orthogonal to the drawing plane of FIG. 2, in order to mention only a few prominent running directions of a possible machine direction MD when fabricating the cover foil 110.

The embodiment of FIG. 2 allows the identification of different rows with first material weakenings 112 parallel to one another and second material weakenings 120 parallel to one another, respectively.

For a start, in FIG. 2 there alternate only first and second material weakenings 112 and 120 respectively in a machine transverse direction CD which is orthogonal to the machine direction MD and parallel to the drawing plane of FIG. 2. Consequently the pattern of material weakenings 112 and 120 of the cover foil 110 exhibits rows 118 proceeding in the machine transverse direction CD, which exhibit along their row length direction RL-118 alternately a first material weakening 112 and a second material weakening 120. Since the weakening spacing SA is respectively the spacing between two first material weakenings 112 parallel to one another or between two second material weakenings 120 parallel to one another, the weakening spacing SA-118 of the rows 118 is comparatively large. Of the rows 118, where only two rows 118 are emphasized through dotted boxes by way of example, each row 118 thus contains both types of first material weakenings 112 parallel to one another and second material weakenings 120 parallel to one another.

In the depicted example, both material weakenings 112 and 120 each exhibit the same running length VL, where the first material weakenings 112 are tilted by an angle α with respect to the direction of the row width RB-118 of the rows 118, which in the depicted example differs in magnitude from the angle α of FIG. 1. The tilt of the second material weakenings 120 with respect to the row width RB-118 is equal in magnitude but exhibits the opposite tilt direction to the tilt of the first material weakenings 112. The second material weakenings 120 are therefore tilted by the angle −α with respect to the row width RB-118. The row width RB-118 therefore again corresponds to the running length of the material weakenings 112 and 120, multiplied by the cosine of the angle α.

As in the example of the first embodiment, in the second embodiment too the individual material weakenings 112 and 120 do not intersect.

In addition, it is possible to define in the cover foil 110 parallel first rows 122 and parallel second rows 124 proceeding in the machine direction MD which differ from the aforementioned rows 118 by the first rows 122 each containing only first material weakenings 112 parallel to one another and the second rows 124 each containing only second material weakenings 120 parallel to one another. In the present example, the possible parallel rows 118 on the one hand and the parallel first rows 122 and second rows 124 on the other are rotated by 90° relative to one another. This, however, need not be the case. Given appropriate offset of the material weakenings 112 and 120 in adjacent first and second rows 122 and 124 respectively along the common row length direction RL-122 and RL-124 respectively, the rows 118 on the one hand and the parallel first rows 122 and second rows 124 on the other can enclose an angle which differs from 90° but also from 0°. This will be further demonstrated below by reference to the third embodiment of FIG. 3.

Relative to the likewise common row widths RB-122 and RB-124, the material weakenings 112 and 120 are tilted by an angle β or −β respectively, where due to the previously described relative position of the rows 118 on the one hand and of the rows 122 and 124 on the other, β=90°−α. Accordingly, the common row widths RB-122 and RB-124 correspond in magnitude to the common running length VL of the material weakenings 112 and 120, multiplied either by the cosine of the angle β or by the sine of the angle α.

Reading from top to bottom, there exists between a first row 122 and a second row 124 immediately adjacent to it a row spacing RD-122 and there exists between a second row 124 and a first row 122 immediately adjacent to it a row spacing RD-124. In the depicted example, the row spacings RD-122 and RD-124 are equal in size.

Because of the use of only equal first material weakenings 122 on the one hand and only equal second material weakenings 120 on the other, the weakening spacing SA-122 which is the same size for both rows 122 and 124 is shorter than the weakening spacing SA-118 of rows 118.

The dimensions shown in FIG. 2 can, without limitation, lie in the following ranges or have the following values, respectively: The running length VL of the material weakenings 112 and 120 can for example have a dimension of 1 to 3 mm, preferably of 1.5 to 2.5 mm, and especially preferably of 2 mm.

The row spacing RD-122 and/or RD 124 respectively can have a value of 0.5 to 1 mm, preferably of 0.65 to 0.8 mm and especially preferably of 0.7 mm.

The weakening spacing SA-122 and/or SA-124 respectively can have a value of 1 to 3 mm, preferably a value of 1.2 to 2.5 mm, especially preferably of 1.5 to 2 mm.

The weakening spacing SA-118 can have a value of 3.5 to 6 mm, preferably of 4.5 to 5.5 mm, especially preferably of 4.7 to 5 mm.

The row spacing RD-118 lies preferably in the ranges quoted above for the row spacings RD-122 and RD 124.

The magnitude of the angle β lies preferably in a range of 20° to 40°, especially preferably in a range of 25° to 35°, and most preferably at 30°. The magnitude of the angle α is obtained from the angle β, in that α and β sum up to 90°.

Figure 3:
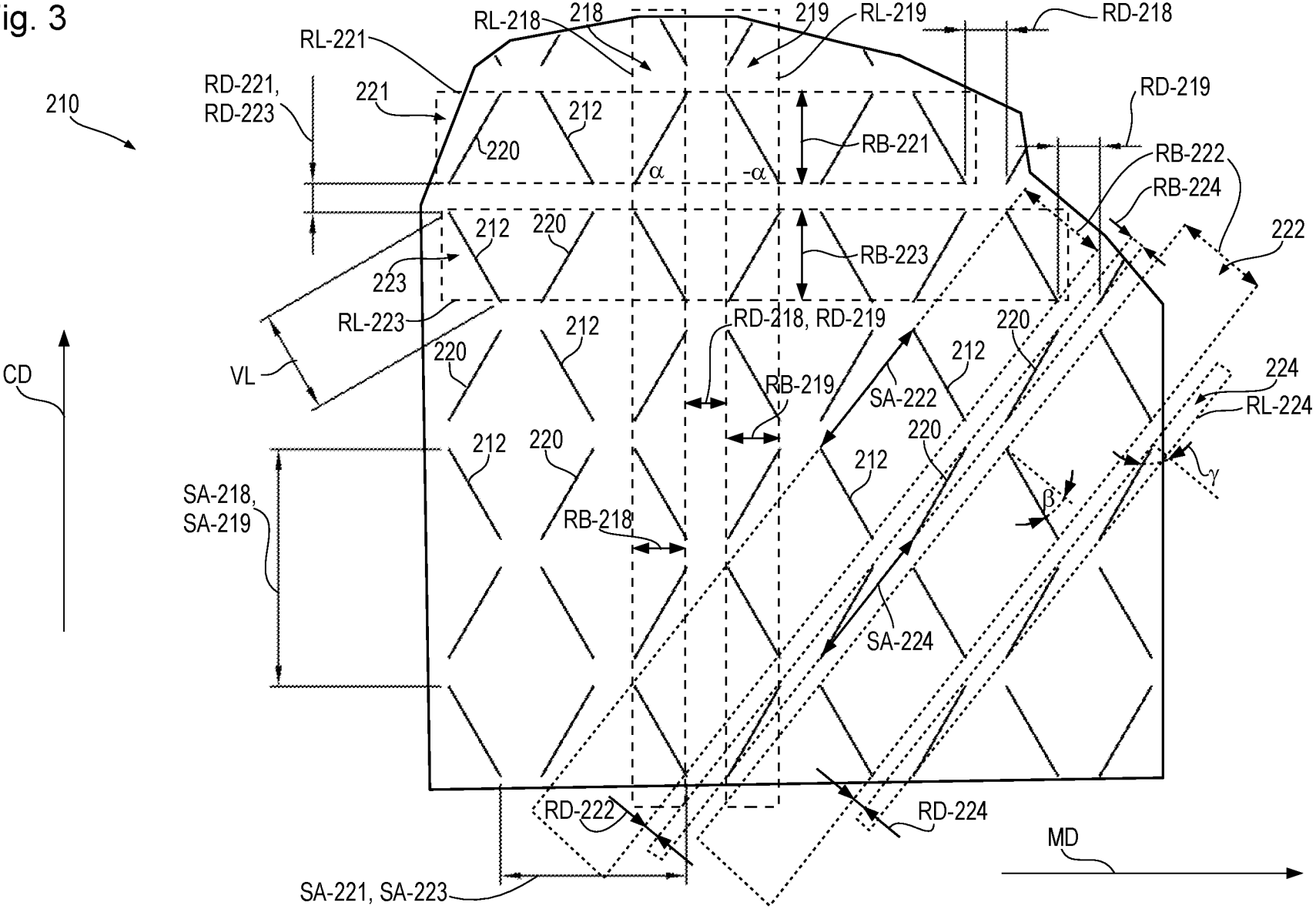

In FIG. 3 there is depicted a third embodiment of a push-through cover foil 210. Identical and functionally identical components and component sections as in FIGS. 1 and 2 are labelled by the same reference symbols but in the numerical range from 200 to 299. The third embodiment of FIG. 3 is described only in so far as it differs from the previously described embodiments of FIGS. 1 and 2, to the description of which reference is otherwise made for elucidating the embodiment of FIG. 3.

The embodiment of the cover foil 210 also exhibits two different types of material weakenings, namely first material weakenings 212 and second material weakenings 220, but in a different spatial distribution than the cover foil 110 of the second embodiment. On the cover foil 210 there are arranged one after another material weakenings in two different spatial directions, which here by way of example and fortuitously correspond to the machine direction MD and the machine transverse direction CD, where unlike the second embodiment of the cover foil 110, in each of these spatial directions first material weakenings 212 and second material weakenings 220 are arranged and configured alternately one after another.

Consequently there is identifiable on the cover foil 210 a first row 218 with material weakenings parallel to one another, which contains both first material weakenings 212 and second material weakenings 220, or contains only the aforementioned material weakenings as the case may be, and which essentially corresponds to the row 118 of the cover foil 110. The row length direction RL-218 of the first row 218 is parallel to the machine transverse direction CD. To the first row 218 there is adjacent with a row spacing RD-218 a second row 219, which is a mirror image of the first row 118 with respect to a mirror-symmetry axis which is parallel to the row length direction RL-218. In other words, the second row 219 corresponds to the first row 218 which is offset by one material weakening along the row length direction RL-218. The rows 218 and 219 alternate in a sequential direction orthogonally to their parallel row length directions RL-218 and RL-219.

To the first row 218 there applies correspondingly what was said about the first row 118 of the second embodiment. To the second row 219 there applies correspondingly what was said about the first row 118 of the second embodiment under the mirror-symmetry condition described above. The matching row width RB-218 and RB-219 of the two rows 218 and 219 respectively equals in each case the running length VL, which in the depicted example is the same size for the first material weakenings 212 and the second material weakenings 220, multiplied by the cosine of the angle α or −α, which however is the same factor.

Orthogonally to the first row 218 and to the second row 219 it is possible to define a third row 221 and a fourth row 223. Basically, the third row 221 corresponds to the first row 122 of the second embodiment with the proviso that each second first material weakening 112 is replaced by a second material weakening 220. Likewise, basically the fourth row 223 corresponds to the second row 124 of the second embodiment with the proviso that each second second material weakening 120 is replaced by a first material weakening 212. The designation third row and fourth row serves merely for differentiation. The row 221 could just as appropriately be designated as second first row 221 and the fourth row 223 could be designated as second second row 223.

The third and the fourth row 221 and 223 are mirror-symmetrical to each other with respect to a mirror-symmetry axis parallel to the parallel row length directions RL-221 and RL-223. Once again, the fourth row 223 can be regarded as a third row 221 offset by one material weakening in the row length direction RL-221.

The equal row widths RB-221 and RB-223 correspond in magnitude to the matching running length VL of the first material weakening 212 and the second material weakening 220, multiplied by the sine of the angle α or −α, which however is the same factor.

Orthogonally to the row length directions RL-221 and RL-223 there follow one another alternately third rows 221 and fourth rows 223, where the row spacings RD-221 between third and fourth rows and the row spacings RD-223 between fourth and third rows are equal in magnitude.

In the third embodiment too, there can be defined rows which exhibit only first material weakenings 212 and only second material weakenings 220. These proceed obliquely with respect to the aforementioned rows 218 and 219 or 221 and 223, as the case may be.

A fifth row or better: a third first row 222 contains—like the row 122 of the second embodiment—only first material weakenings 212. A sixth or better: third second row 224 parallel to the fifth row 222 contains—like the row 124 of the second embodiment—only second material weakenings 220.

Orthogonally to the parallel row length directions RL-222 and RL-224 there follow alternately fifth rows 222 and sixth rows 224, each with equal in magnitude row spacings RD-222 between fifth and sixth rows and RD-224 between sixth and fifth rows.

The first material weakenings 212 are tilted by an angle β with respect to the direction of the row width RB-222 of the fifth (or the third first, as the case may be) row 222. The second material weakenings 212 are tilted by an angle γ with respect to the direction of the row width RB-224 of the sixth (or the third second, as the case may be) row 224, where unlike the second embodiment the angle γ in the third embodiment differs in magnitude from the angle β, even differs considerably. Therefore, the row widths RB-222 on the one hand and RB-224 on the other are different, in particular considerably different, due to the very different cosines of the angle β on the one hand and γ on the other.

Due to the overall symmetrical arrangement of the first material weakenings 212 and the second material weakenings 220, as manifested first and foremost by the two mirror-symmetrical row pairs 218 and 219 on the one hand 221 and 223 on the other, the weakening spacings SA-122 on the one hand and SA-224 on the other are equal in size in the depicted example.

The individual dimensions can have the following value ranges: The row spacings RD-218 and RD-219 can have a value in a range from 0.5 to 1.5 mm, preferably from 0.7 to 1.3 mm, especially preferably from 1 mm. The row spacings RD-218 and RD-219 do not have to be equal in size, but preferably are.

The row widths RB-218 and RB-219 lie preferably between 0.6 and 2 mm, especially preferably between 0.9 and 1.7 mm, and most preferably between 1.1 and 1.4 mm.

The angle α is between 40° and 80°, preferably between 50° and 70°, especially preferably 60°.

The row spacings RD-221 and RD-223 can have a value in a range from 0.3 to 1.2 mm, preferably from 0.5 to 0.9 mm, especially preferably from 0.7 mm. The row spacings RD-221 and RD-223 do not have to be equal in size, but preferably are.

The weakening spacings SA-218 and SA-219 can lie in a range from 4.5 to 6.5 mm, preferably from 5.2 to 6 mm, especially preferably from 5.65 to 5.8 mm. The weakening spacings SA-218 and SA-219 do not have to be equal in size, but preferably are.

The weakening spacings SA-221 and SA-223 can lie in a range from 3.5 to 6 mm, preferably from 3.9 to 5 mm, especially preferably from 4.35 to 4.6 mm. The weakening spacings SA-221 and SA-223 do not have to be equal in size, but preferably are.

The row width RB-222 lies preferably between 1.6 and 3 mm, especially preferably between 1.8 and 2.6 mm and especially preferably between 2.1 and 2.35 mm.

The row width RB-224 lies preferably between 0.1 and 0.6 mm, especially preferably between 0.2 and 0.5 mm and especially preferably between 0.3 and 0.4 mm.

The weakening spacings SA-222 and SA-222 can lie in a range from 2.7 to 4.2 mm, preferably from 3.1 to 3.8 mm, especially preferably from 3.25 to 3.4 mm. The weakening spacings SA-221 and SA-223 do not have to be equal in size, but preferably are.

The running length VL of the first and the second material weakenings 212 and 220 respectively lies preferably between 1.5 and 3 mm, especially preferably between 1.8 and 2.7 mm, and most preferably between 2 and 2.5 mm.

The angle β lies preferably between 10° and 40°, especially preferably between 20° and 30°, most preferably 25°.

The angle γ lies preferably between 60° and 85°, especially preferably between 70° and 85°, most preferably between 80° and 83°.

Figure 4:
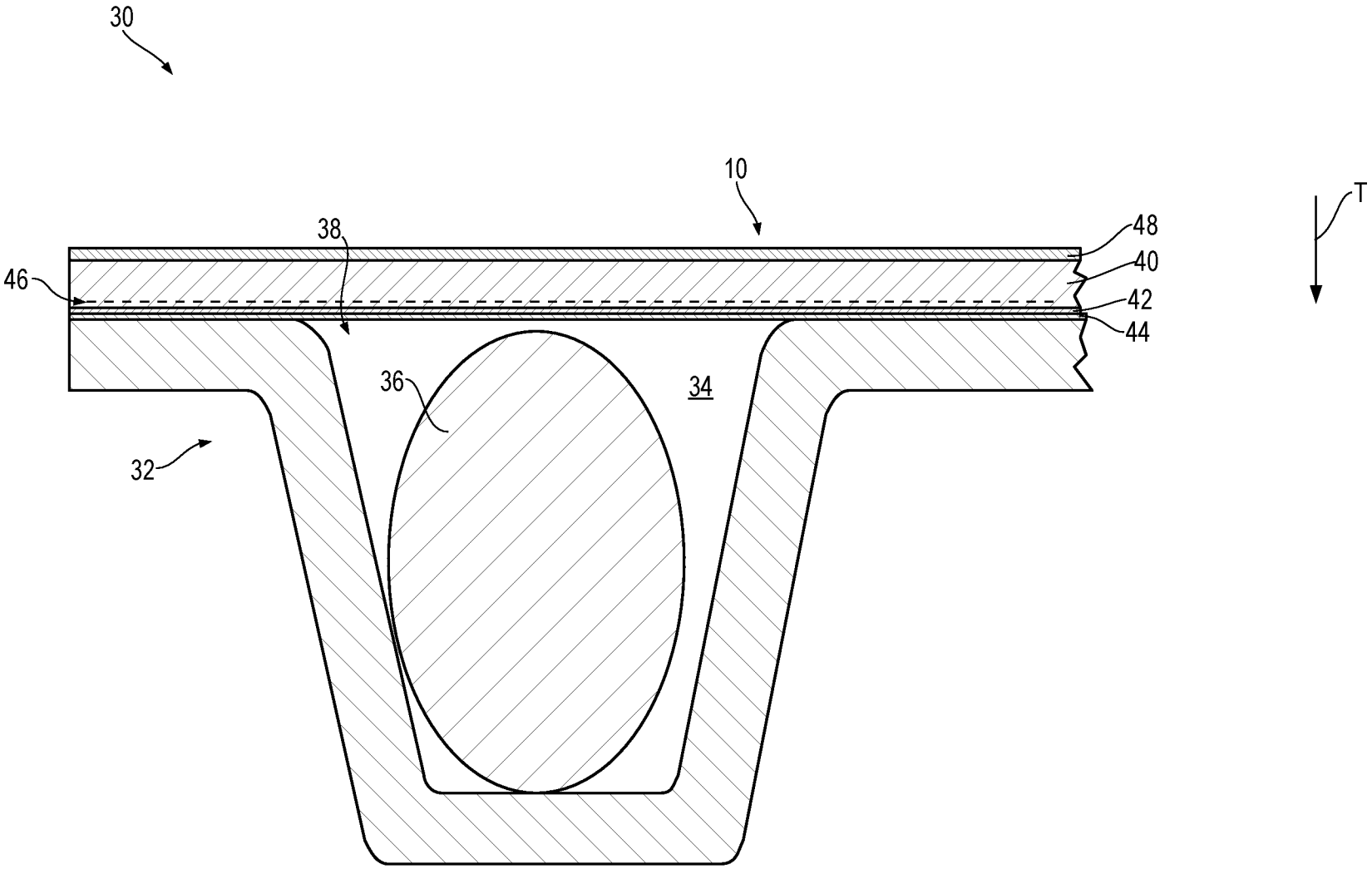

In FIG. 4, which is not to scale, there is depicted in rough schematic form a section of a first embodiment of a push-through pack 30 according to the invention. It comprises a container component 32, in which an accommodation volume 34 is configured in which a product 36, for example a tablet, is accommodated. The accommodation volume 34 is accessible through an aperture 38, which is sealed by an embodiment of a push-through cover foil according to the invention, for instance the push-through cover foil 10.

In the depicted example, the cover foil 10 is a polymer mono-foil 40 which in order to facilitate recycling of the entire push-through pack 30 is made from the same polymer as the container component 32. The polymer can be polyethylene terephthalate or a polyolefin, in particular polypropylene. Especially preferably, the polymer is a monoaxially or biaxially oriented or stretched polymer as the case may be, such as for example oPet, MOPP or BOPP.

On the side of the polymer mono-foil 40 facing towards the container component 32 there is applied in the depicted example a ceramic barrier layer 42, for example made from aluminum oxide and/or silicon oxide. This should hamper the migration of water vapor and oxygen from the external environment into the accommodation volume 34.

On the side of the barrier layer 42 facing away from the polymer mono-foil 40 and facing towards the container component 32 there is applied a sealing layer 44, for example made from a polyolefin, with which the cover foil 10 is firmly sealed with the container component 32 in order to close the aperture 38 securely.

The dashed line 46 indicates the end of the material weakenings which are introduced from the side of the polymer mono-foil 40 facing away from the container component 32 in the depth direction T into the polymer mono-foil 40. The material weakenings do not completely penetrate through the polymer mono-foil 40 in the thickness direction, such that a rest of the polymer mono-foil 40 and above all the barrier layer 42 remains uncompromised by the material weakenings and intact.

Onto the side of the polymer mono-foil 40 facing away from the container component 32 there can be applied an applied printed layer 48, multilayer where relevant, including a protective varnish layer, in order to convey product data to the consumer. Alternatively, the polymer mono-foil 40 can also be printed in reverse printing, where the applied printed layer then cannot form the outermost layer but rather there has to be applied between it and the container component 32 the sealing layer 44 or another adhesive layer, such as for example a cement layer.

In the embodiment example of FIG. 4, the applied printed layer 48 can cover the material weakenings from outside, such that for the consumer these are initially neither visible nor palpable. Since, however, the applied printed layer 48 cannot accommodate especially large tensions and forces, the applied printed layer 48 does not hinder pushing through of the cover foil 10 through deformation of the container component 32 in the region of the accommodation volume 34 under force transmission through the product 36.

Figure 5:
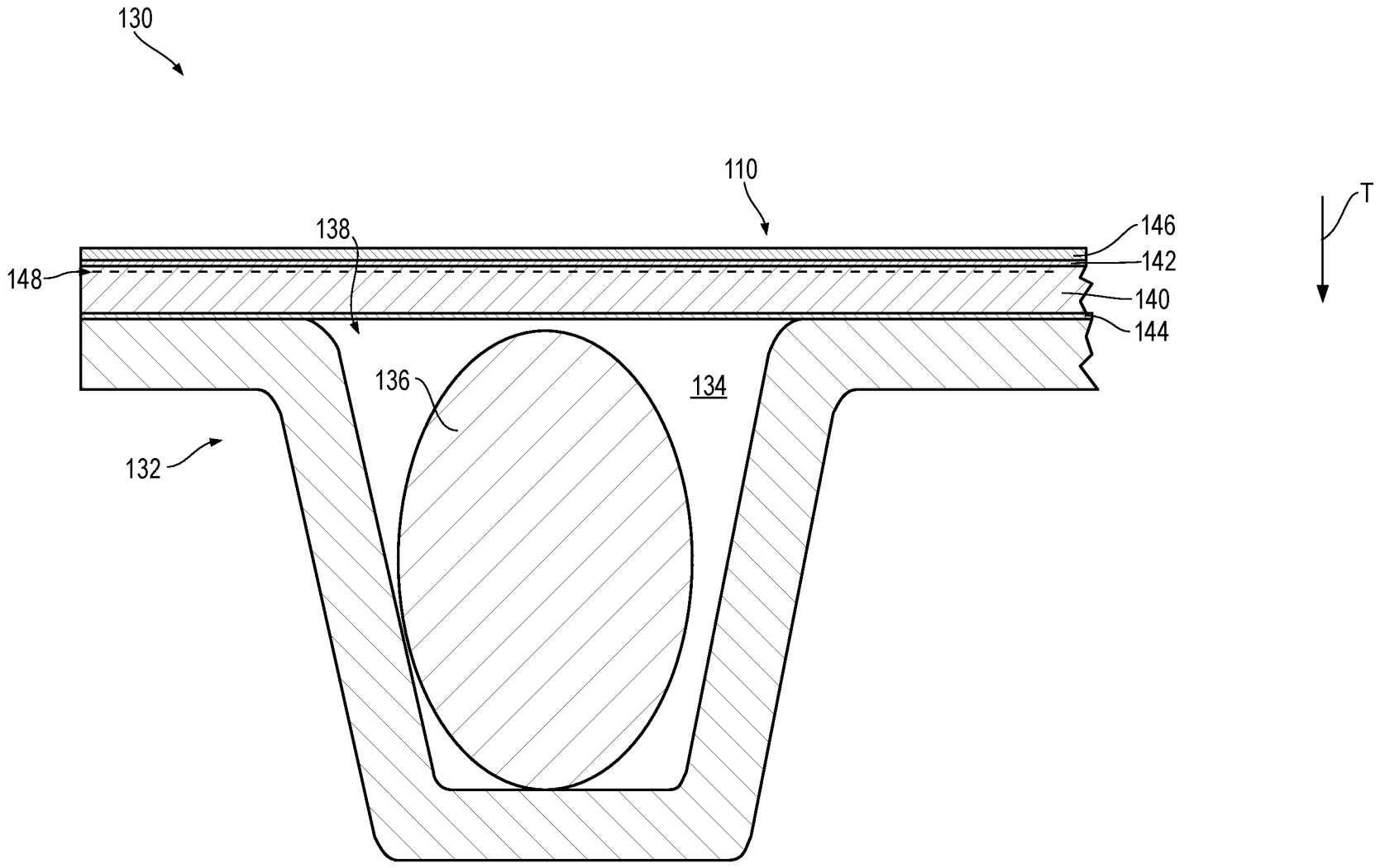

In FIG. 5 there is depicted a second embodiment of a push-through pack according to the invention, again not to scale.

Identical and functionally identical components and component sections as in FIG. 4 are labelled in FIG. 5 by the same reference symbols, but increased numerically by 100. The cover foil can therefore be the cover foil 110 from FIG. 2.

The second embodiment of FIG. 5 is described below only in so far as it differs from the first embodiment of FIG. 4, to the description of which reference is otherwise made for elucidating the second embodiment of FIG. 5 also.

The container component 132 is the same container component as in the first embodiment, likewise the product 136 packaged in the push-through pack 130.

In contrast to the first embodiment, in the cover foil 110 the material weakenings are introduced from the side of the sealing layer 144 in the thickness direction into the cover foil 110. Therefore, for one thing the dashed line 146, which indicates the end of the material weakenings in the polymer mono-foil 140, lies nearer to the outer surface of the polymer mono-foil 140 facing away from the container component 132, and therefore for another the barrier layer 142 is applied on the outer surface of the polymer mono-foil 140 facing away from the container component 132 in order to prevent reliably compromising the barrier layer 142 by the introduction of material weakenings into the cover foil 110.

The barrier layer 142 can be a ceramic barrier layer as in in the first embodiment or vapor-deposited metallizing.

On the outer side of the barrier layer 142 pointing away from the polymer mono-foil 140 and from the container component 132 there can again be applied an applied printed layer 148, multilayer where relevant.

The cover foil 210 of FIG. 3 forms, through the mutually orthogonal arrangement regions 218, 219 on the one hand and 221, 223 on the other, an orthogonal arrangement pattern of the material weakenings 212 and 220.

In many or even most cases, the accommodation volumes in a container component are also arranged in an orthogonal pattern. Since a container component preferably exhibits only one and the same product packaged in its accommodation volumes, the accommodation volumes of a container component are preferably configured with the same size and with the same shape.

An especially advantageous effect with a low push-through force needed for local pushing through the cover foil 210 of FIG. 3, is achieved when the orthogonal arrangement pattern defined on the cover foil 210 is rotated by an angle of 30° to 60°, preferably by an angle of 40° to 50°, especially preferably by 45° with respect to an orthogonal grid of the accommodation volumes in the container component.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A push-through cover foil, comprising at least one material layer with material weakenings introduced into it in a regular pattern, through which locally a material cohesion of at least one material of the cover foil is broken, where the material weakenings proceed in the thickness direction of the cover foil without completely penetrating through the cover foil, where the material weakenings exhibit a linear course orthogonally to the thickness direction, wherein the cover foil exhibits a plurality of parallel rows of material weakenings, where each row exhibits a plurality of material weakenings parallel to one another and arranged with a weakening spacing from one another, where the parallel rows of material weakenings are arranged with a row spacing from one another such that neither the material weakenings of the individual rows among themselves nor the material weakenings of adjacent rows intersect one another, wherein running directions of material weakenings extend orthogonal to the thickness direction of the cover foil, wherein running directions of material weakenings of a row enclose with the row extension direction a setting angle, wherein a row of material weakenings parallel to one another exhibits only material weakenings parallel to one another, wherein the cover foil exhibits a plurality of parallel equal rows, in which material weakenings are configured with a uniform setting angle and with a uniform weakening spacing, wherein the plurality of equal rows are first rows in which material weakenings are configured with a uniform first setting angle and with a uniform first weakening spacing, where the cover foil exhibits a plurality of parallel second equal rows in which material weakenings are configured with a uniform second setting angle different from the first setting angle and with a uniform second weakening spacing, where between two first rows there is arranged at least one second row and where between two second rows there is arranged at least one first row.

2. The push-through cover foil according to claim 1, wherein out of a plurality of parallel rows each row exhibits along its row extension direction which is orthogonal to the row spacing a row width which is determined by the material weakenings of the respective row, where the row width is constant and orthogonal to the row extension direction.

3. The push-through cover foil according to claim 2, wherein the constant row width is greater than the constant row spacing between adjacent rows of constant width.

4. The push-through cover foil according to claim 1, wherein running directions of the material weakenings of a row which are parallel to one another and orthogonal to the thickness direction of the cover foil enclose with the row extension direction a setting angle different from 90°.

5. The push-through cover foil according to claim 1, wherein the parallel material weakenings of one row are arranged offset, in the common row extension direction of the two rows, relative to the further material weakenings of a further parallel row which are directionally aligned with the material weakenings of this row.

6. The push-through cover foil according to claim 1, wherein the first weakening spacing and the second weakening spacing are of equal size.

7. The push-through cover foil according to claim 1, wherein the push-through cover foil is a mono-material polymer foil.

8. The push-through cover foil according to claim 7, wherein the push-through cover foil is a polymer mono-foil.

9. The push-through cover foil according to claim 7, wherein the push-through cover foil comprises several layers made of polymer material, where the polymers of the several layers made of polymer material are based on the same monomer.

10. The push-through cover foil according to claim 7, wherein the push-through cover foil consists of several layers made of polymer material, where the polymers of the several layers made of polymer material are based on the same monomer.

11. A push-through pack, comprising a manually deformable container component with at least one accommodation volume framed by the container component for accommodating a product to be packaged, where the accommodation volume is reducible by manually exerting a force, where the container component exhibits a removal aperture for removing the product to be packaged which is sealed by a push-through cover foil according to claim 1, where the material weakenings of the push-through cover foil are dimensioned relative to the dimensions of the removal aperture covered by it in such a way that within the aperture area framed by the removal aperture and covered by the push-through cover foil more than one row of material weakenings are provided parallel to one another and at least two of these rows each exhibit more than one material weakening.

12. The push-through pack according to claim 11, wherein the material weakenings in the push-through cover foil, starting on the outer side which faces away from the at least one accommodation volume, proceed in the thickness direction in the direction towards the inner side which faces towards the at least one accommodation volume and lies opposite to the outer side.

13. The push-through pack according to claim 11, wherein the material weakenings in the push-through cover foil, starting on the inner side which faces towards the at least one accommodation volume, proceed in the thickness direction in the direction towards the outer side which faces away from the at least one accommodation volume and lies opposite to the inner side.

* * * * *